US009818564B2

(12) United States Patent
Zhao et al.

(10) Patent No.: US 9,818,564 B2
(45) Date of Patent: Nov. 14, 2017

(54) MAGNETIC PROXIMITY SWITCH

(71) Applicant: CHUANDONG MAGNETIC ELECTRONIC CO., LTD, Foshan, Guangdong (CN)

(72) Inventors: Tianan Zhao, Guangdong (CN); Kewen Long, Guangdong (CN); Tianbao Yan, Guangdong (CN)

(73) Assignee: CHUANDONG MAGNETIC ELECTRONICS CO., LTD. (CN)

( * ) Notice: Subject to any disclaimer, the term of this patent is extended or adjusted under 35 U.S.C. 154(b) by 0 days.

(21) Appl. No.: 15/313,520

(22) PCT Filed: Oct. 13, 2014

(86) PCT No.: PCT/CN2014/088450

§ 371 (c)(1),
(2) Date: Nov. 22, 2016

(87) PCT Pub. No.: WO2015/192553

PCT Pub. Date: Dec. 23, 2015

(65) Prior Publication Data

US 2017/0200576 A1 Jul. 13, 2017

(30) Foreign Application Priority Data

Jun. 17, 2014 (CN) ..... 2014 1 0271176

(51) Int. Cl.
*H01H 36/00* (2006.01)
*H01H 36/02* (2006.01)

(52) U.S. Cl.
CPC ..... *H01H 36/0073* (2013.01); *H01H 36/02* (2013.01)

(58) Field of Classification Search
CPC ..... H01H 36/0073; H01H 36/02
USPC ..... 335/205, 207
See application file for complete search history.

(56) References Cited

U.S. PATENT DOCUMENTS 4,117,431 A * 9/1978 Eicher ..... H01H 36/00 335/207
4,837,539 A * 6/1989 Baker ..... H01H 36/008 324/207.26

* cited by examiner

*Primary Examiner* — Ramon M Barrera

(57) ABSTRACT

The present invention relates to a magnetic proximity switch, comprising a casing, and a balance plate is transversely provided in the middle within the casing; a dynamic magnet and a static magnet are disposed in parallel on the left and right sides above the balance plate; the left end of the balance plate is hinged within the casing; the lower surface of the right end of the balance plate is provided with a dynamic contact; the balance plate is connected to the dynamic magnet via an elastic component A; a wiring terminal A and a wiring terminal B are fixed in parallel on the left and right sides at the bottom in the casing; the top of the wiring terminal A is connected to the balance plate via an elastic component B; the upper portion of the wiring terminal B is transversely bent.

15 Claims, 2 Drawing Sheets

MAGNETIC PROXIMITY SWITCH

FIELD OF INVENTION

The present invention relates to the technical field of proximity switches, and more particularly, to a normally-open and high-current proximity switch.

BACKGROUND

The magnetic proximity switch is a device capable of being switched on/off through the interaction of the dynamic magnet, the static magnet and the external magnet, which are currently being widely used in many technical fields. The present device's structure is efficient, and can directly determine the quality and the functional life of the new magnetic proximity switch.

In the prior art, the traditional proximity switch has some shortcomings due to its unreasonable structure. For instance, Chinese patent ZL201220483811.8 discloses a magnetic micro switch, of which the two sides are respectively provided with a magnet for attracting or repulsing the dynamic magnet in the middle part, aiming to control the switch through the attraction and separation of the contacts. One disadvantage of this arrangement is that the magnets disposed at the two sides are required to overcome the corresponding counterforce, easily resulting in an arcing problem due to the small acting force generated by the attraction and separation of the contacts. Additionally, the Chinese patents ZL201020102625.6 and ZL201020670583.6 disclose a normally-open magnetic micro switch. The major difference between the two patents is the different positions of the internal magnets and the pivot points. However, both inventions realize the motions via an elastic motion rod. Namely, the attraction and separation of the contacts are completely rely on the elastic motion rod, which generates a small acting force, low speed, and easy-arcing.

In conclusion, the shortcomings of the traditional proximity switch are urgent, and need to be overcome for those skilled in this field.

SUMMARY OF THE INVENTION

The purpose of the present invention is to provide a proximity switch, which can greatly improve the instantaneous acting force generated by the attraction and separation of the contacts, and effectively solves the technical problem of arcing in the prior art.

To achieve the above purpose, the present invention adopts the following technical solution:

A magnetic proximity switch comprising a casing. A balance plate is transversely disposed in the middle within the casing. A dynamic magnet and a static magnet are disposed in parallel on the left and right sides above the balance plate. The left end of the balance plate is hinged within the casing. The lower surface of the right end of the balance plate is provided with a dynamic contact. The balance plate is connected to the dynamic magnet via an elastic component A. A wiring terminal A and a wiring terminal B are fixed in parallel on the left and right sides at the bottom in the casing. The top of the wiring terminal A is connected to the balance plate via an elastic component B. The upper portion of the wiring terminal B is transversely bent. A static contact is provided on the bent portion and corresponds to the dynamic contact. A magnet-attracted component A, which is disposed on the balance plate, corresponds to the lower end of the static magnet.

In another aspect of the present invention, a locking piece, which is disposed in the casing, further comprises a transverse-direction piece and a vertical-direction piece. The transverse-direction piece and the vertical-direction piece are connected through a pivot point. The locking piece, which rotates around the pivot point, is disposed in the casing. The outer end of transverse-direction piece is disposed on the dynamic magnet. A locking mechanism is disposed between the outer end of the vertical-direction piece and the right end of the balance plate. A magnet-attracted component B, which is disposed on the lower surface of the transverse-direction piece, corresponds to the upper end of the static magnet.

In another aspect of the present invention, a supporting column is disposed in the casing, and a space is formed between the supporting column and the top right corner of the casing. The pivot point is rotatably disposed in said space.

In another aspect of the present invention, the locking mechanism comprises an engaging slot disposed at the right end of the balance plate and an engaging piece disposed at the lower end of the vertical-direction piece. The engaging piece is engaged with the engaging slot.

In another aspect of the present invention, the transverse-direction piece of the locking piece is disposed in parallel with the balance plate. The vertical-direction piece of the locking piece is perpendicular to the balance plate.

In another aspect of the present invention, a sliding chute is disposed in the casing, and the dynamic magnet, which can move up and down, is disposed in the sliding chute.

In another aspect of the present invention, a sliding rail is disposed in the sliding chute, and the dynamic magnet is disposed on the sliding rail.

In another aspect of the present invention, the elastic component A and the elastic component B are elastic sheets.

In another aspect of the present invention, the top of the wiring terminal A is provided with a support frame, and the left end of the balance plate is hinged to the support frame.

In another aspect of the present invention, the magnet-attracted component A and the magnet-attracted component B are iron rivets.

Compared with the prior art, the present invention has the following advantages: The dynamic magnet moves down under the action of the external magnet to overcome the upward acting force of the elastic component A and the elastic component B as well as the acting force between the magnet-attracted component A and the static magnet. The static contact and the dynamic contact are quickly attracted or separated to generate a large instantaneous acting force, thus effectively solving the technical problem of the arcing in the prior art. Consequently, the functional life of the present invention can be effectively prolonged and the application field can be greatly expanded.

MARKING INSTRUCTIONS OF THE DRAWINGS

1, Casing 11, Sliding Chute, 12, Supporting Column, 13, Accommodating space,

2, Dynamic magnet, 3, Static Magnet,
4, Locking Piece, 41, Transverse-direction piece, 42, Vertical-direction piece, 43, Pivot Point,
411, Magnet-attracted Component B, 421, Engaging Piece,
5, Balance Plate, 51, Dynamic Contact, 52, Elastic Component A, 53, Elastic Component B,
54, Engaging Slot, 55, Magnet-attracted Component A,
6, Wiring Terminal B, 61, Static Contact,
7, Wiring Terminal A, 71, Supporting Frame

DETAILED DESCRIPTION OF THE INVENTION

Drawings and detailed embodiments are combined hereinafter to elaborate the technical principles of the present invention.

Figure 1:
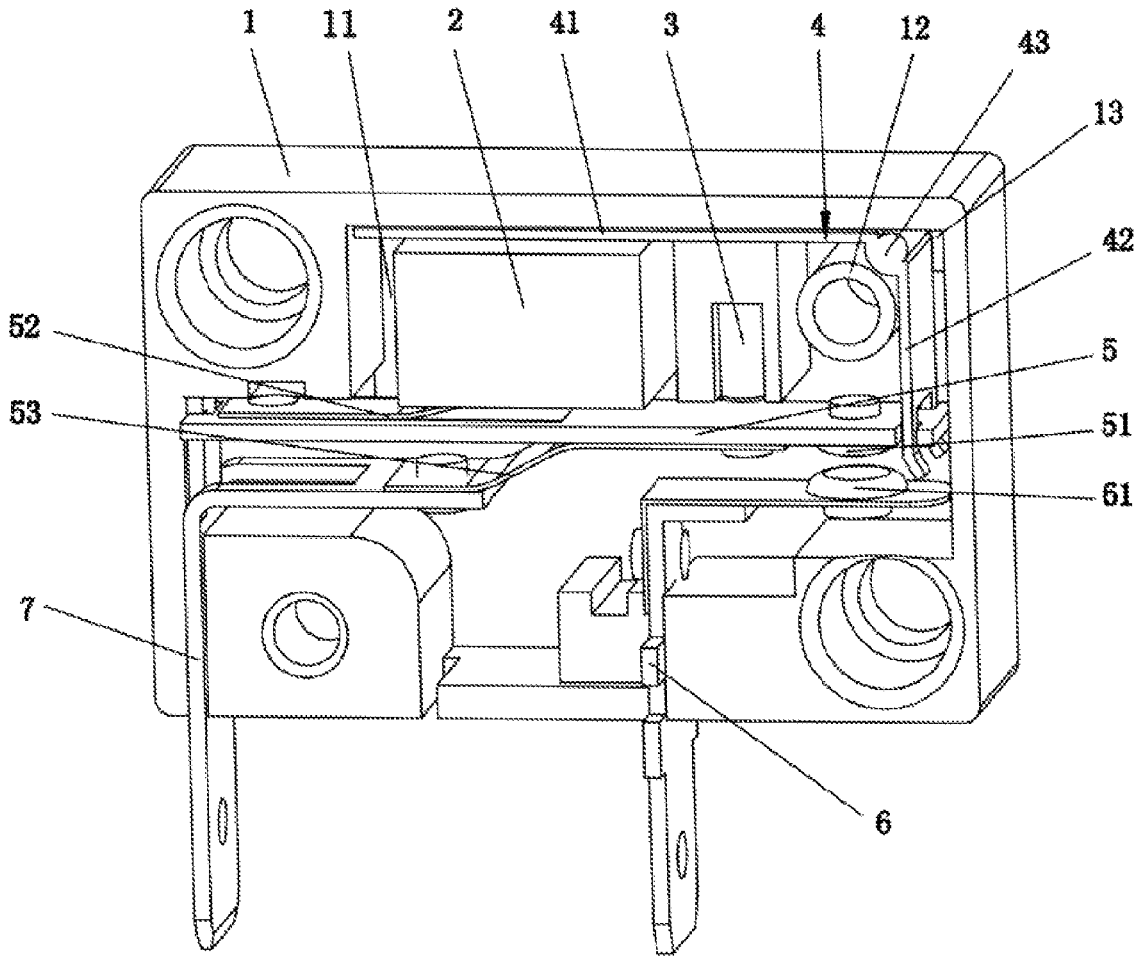
FIG. 1 is an overall structure diagram of the present invention.
Figure 2:
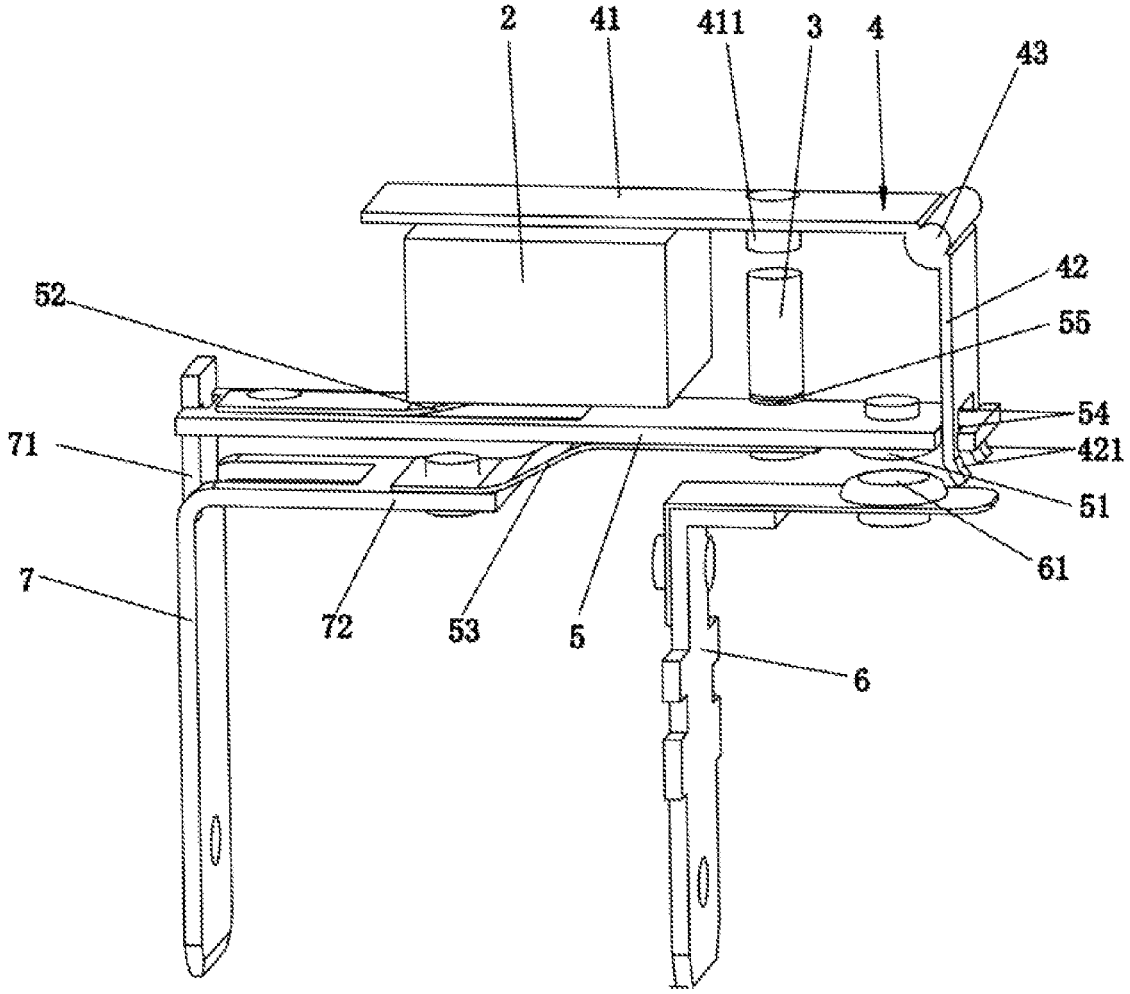
FIG. 2 is a structure diagram of the present invention after removing the casing.

As shown in FIGS. 1 and 2, the magnetic proximity switch comprises a casing 1, which is made of insulating material. The design of the casing 1 is similar to the prior art, which is briefly described herein.

A balance plate 5, which is made of metal material, is transversely disposed in the middle within the casing 1. The left end of the balance plate 5 is hinged to the supporting frame 71. The lower surface of the right end of the balance plate 5 is provided with a dynamic contact 51. The balance plate 5 can swing up and down around the left end of the balance plate 5, facilitating the dynamic contact 51 to move up and down.

A dynamic magnet 2 and a static magnet 3 are disposed in parallel on the left and right sides above the balance plate 5. Specifically, a sliding chute 11 is disposed in the casing 1, and the dynamic magnet 2, which can move up and down, is disposed in the sliding chute 11. The sliding chute 11 is provided with a sliding rail, and the dynamic magnet 2 is disposed on the sliding rail, enabling the dynamic magnet 2 to move more firmly. The static magnet 3 and the dynamic magnet 2, which are disposed in parallel, are fixed in the casing 1.

The balance plate 5 is connected to the dynamic magnet 2 via an elastic component A52. Preferably, the elastic component A52 is an elastic sheet made of metal material. The two ends of the elastic sheet are respectively connected to the bottom of the balance plate 5 and the upper surface of the dynamic magnet 2.

The wiring terminal A7 and the wiring terminal B6 are fixed in parallel on the left and right sides at the bottom in the casing 1.

The top of the wiring terminal A7 is connected to the balance plate 5 via an elastic component B53. Preferably, the elastic component B53 of the present invention is an elastic sheet made of metal material. The two ends of the elastic sheet are respectively connected to the top of the wring terminal A7 and the lower surface of the balance plate 5.

The supporting frame 71 is fixed to the top of the wiring terminal A7. According to this arrangement, the integrality of the present invention can be effectively improved, and the connecting structure can be fully optimized. Moreover, the upper portion of the wiring terminal B6 is transversely bent; and, a static contact 61 is disposed on the bent portion and corresponds to the dynamic contact 51.

A locking piece 4, which is disposed in the casing 1, further comprises a transverse-direction piece 41 and a vertical-direction piece 42. The transverse-direction piece 41 and the vertical-direction piece 42 are firmly connected through a pivot point 43. The locking piece 4, which rotates around the pivot point 43, is disposed in the casing 1. The outer end of transverse-direction piece 41 is disposed on the dynamic magnet 2. A locking mechanism is disposed between the outer end of the vertical-direction piece 42 and the right end of the balance plate 5. Preferably, a supporting column 12 is disposed in the casing 1, and an accommodating space 13 is formed between the supporting column 12 and the top right corner of the casing 1. The pivot point 43 is rotatably disposed in the accommodating space 13. In the initial state (namely, when the static contact 61 and the dynamic contact 51 are separated), the transverse-direction piece 41 of the locking piece 4 is disposed in parallel with the balance plate 5, and the vertical-direction piece 42 of the locking piece 4 is perpendicular to the balance plate 5. The transverse-direction piece 41, which is made of metal material, is disposed on the dynamic magnet 2, and moves up and down along the dynamic magnet 2.

Furthermore, the locking mechanism comprises an engaging slot 54 at the right end of the balance plate 5 and an engaging piece 421 at the lower end of the vertical-direction piece 42. The engaging piece 421 is engaged with the engaging slot 54.

A magnet-attracted component B411, which is disposed on the lower surface of the transverse-direction piece 41, corresponds to the upper end of the static magnet 3. A magnet-attracted component A55, which is disposed on the balance plate 5, corresponds to the lower end of the static magnet 3. The magnet-attracted component A55 and the magnet-attracted component B411 are rivets, which are preferably high-quality iron rivets.

The working principle of the present invention is the following: As shown in FIG. 1, the initial state of the present invention is that the dynamic contact 51 and the static contact 61 are separated. Namely, the present invention is switched off (normally-open state). At the moment, the dynamic magnet 2 is located at the upper portion of the sliding chute 11. The elastic component A52 and the elastic component B53 maintain a relatively unstressed state. The magnet-attracted component A55 is attracted by the lower end of the static magnet 3. The balance plate 5 and the transverse-direction piece 41 of the locking piece 4 are kept in a horizontal state. At this time, a fixed angle is formed by the vertical-direction piece 42 and the transverse-direction piece 41 of the locking piece 4. Preferably, the vertical-direction piece 42 is perpendicular to the transverse-direction piece 41, and the engaging piece 421 is engaged with the engaging slot 54 to lock the device, enabling the two contacts to be firmly separated. When initiating the present invention, the external magnet moves close to the upper portion of the casing 1, and the external magnet propels the dynamic magnet 2 to move down. During this process, the magnet-attracted component B411 on the transverse-direction piece is attracted by the static magnet 3, enabling the left end of the transverse-direction piece 41 to move downwards. As well, the dynamic magnet 2 is required to overcome the upward acting force of the elastic component A52 and the elastic component B53, as well as the attraction between the magnet-attracted component A55 and the static magnet 3. Thus, the right end of the balance plate 5 moves down around the left end. At this moment, the vertical-direction piece 42 of the locking piece 4 moves to the right (rotates outward). When the transverse-direction piece 41 moves to a certain position, the magnet-attracted component B411 is attracted by the upper end of the static magnet 3, which accelerates the downward movement of the transverse-direction piece 41 of the locking piece 4. Meanwhile, the vertical-direction piece 42 of the locking piece 4 moves to the right, allowing the engaging piece 421 to be separated from the engaging slot 54 until the bottom of the engaging piece 421 has been against the upper surface of the outer edge of the engaging slot 54. Consequently, the right end of the balance plate 5 is prevented from moving upwards, thus locking the balance plate 5, which ensures a stable and close contact between the static contact 61 and the dynamic contact 51. Consequently, the present invention is switched on. According to the above, the present invention can only be turned into the switching-on state by an enough acting force. Consequently, the present invention can quickly switch on/off, enabling the static contact 61 to be firmly contacted with the dynamic contact 51. When reverting to the initial state, the external magnet can be removed, and the dynamic magnet 2 can move up under the action of the elastic component A52 and the elastic component B53. Meanwhile, the transverse-direction piece 41 can be pushed up by the dynamic magnet 2 after overcoming the attraction between the magnet-attracted component B411 and the static magnet 3. Consequently, the engaging piece 421 of the vertical-direction piece can be propelled to move to the left until the engaging piece 421 has been separated from the surface of the engaging slot 54 and slid into the engaging slot 54. At this moment, the static magnet 3 and the magnet-attracted component A55 are quickly separated, accelerating the unlocking process of the transverse-direction piece 41. Therefore, the device can be unlocked rapidly. Once the transverse-direction piece 41 is unlocked, the balance plate 5 can quickly move up, thus switching the device off (separated state of the contacts).

When the dynamic contact 51 and the static contact 61 are attracted or separated, the instantaneous acting force of the present invention is greater than that in the prior art (testing results show that the instantaneous acting force in the prior art is less than 30 g, and that of the present invention is greater than 70 g). Due to the fast speed produced by the large instantaneous force, the technical problem of arcing in the prior art can be effectively solved, enabling the present invention to be widely applied in the field of high-power electrical appliances, of which the rated current can be higher than 10 A and the power can exceed 2500 W. Thus, the application range of the present invention can be greatly expanded.

Even better, due to the large instantaneous acting force generated when the contacts are attracted or separated, the design of the external magnet and the dynamic magnet can be changed from the former neodymium iron boron magnet to the ferrite magnet, which can reduce production costs by 30%.

The description of the above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A magnetic proximity switch, comprising:

a casing, wherein a balance plate is transversely disposed in the middle within the casing, wherein a dynamic magnet and a static magnet are disposed in parallel on the left and right sides above the balance plate, wherein the left end of the balance plate is hinged within the casing, wherein the lower surface of the right end of the balance plate is provided with a dynamic contact, wherein the balance plate is connected to the dynamic magnet via an elastic component A, wherein a wiring terminal A and a wiring terminal B are fixed in parallel on the left and right sides at the bottom in the casing, wherein the top of the wiring terminal A is connected to the balance plate via an elastic component B, wherein the upper portion of the wiring terminal B is transversely bent, wherein a static contact is provided on the bent portion and corresponds to the dynamic contact, wherein a magnet-attracted component A, which is disposed on the balance plate, corresponds to the lower end of the static magnet.

2. The magnetic proximity switch of claim 1, wherein a locking piece, which is disposed in the casing, further comprises a transverse-direction piece and a vertical-direction piece, wherein the transverse-direction piece and the vertical-direction piece are connected through a pivot point, wherein the locking piece, which rotates around the pivot point, is disposed in the casing, wherein the outer end of transverse-direction piece is disposed on the dynamic magnet, wherein a locking mechanism is disposed between the outer end of the vertical-direction piece and the right end of the balance plate, wherein a magnet-attracted component B, which is disposed on the lower surface of the transverse-direction piece, corresponds to the upper end of the static magnet.

3. The magnetic proximity switch of claim 2, wherein a supporting column is disposed in the casing, and an accommodating space is formed between the supporting column and the top right corner of the casing, wherein the pivot point is rotatably disposed in the accommodating space.

4. The magnetic proximity switch of claim 3, wherein the locking mechanism comprises an engaging slot disposed at the right end of the balance plate and an engaging piece disposed at the lower end of the vertical-direction piece, wherein the engaging piece is engaged with the engaging slot.

5. The magnetic proximity switch of claim 4, wherein the transverse-direction piece of the locking piece is disposed in parallel with the balance plate, wherein the vertical-direction piece of the locking piece is perpendicular to the balance plate.

6. The magnetic proximity switch of claim 1, wherein a sliding chute is disposed in the casing, and the dynamic magnet, which can move up and down, is disposed in the sliding chute.

7. The magnetic proximity switch of claim 6, wherein a sliding rail is disposed in the sliding chute, and the dynamic magnet is disposed on the sliding rail.

8. The magnetic proximity switch of claim 6, wherein the elastic component A and the elastic component B are elastic sheets.

9. The magnetic proximity switch of claim 6, wherein the top of the wiring terminal A is provided with a support frame, and the left end of the balance plate is hinged to the supporting frame.

10. The magnetic proximity switch of claim 6, wherein the magnet-attracted component A and the magnet-attracted component B are iron rivets.

11. The magnetic proximity switch of claim 5, wherein a sliding chute is disposed in the casing, and the dynamic magnet, which can move up and down, is disposed in the sliding chute.

12. The magnetic proximity switch of claim 11, wherein a sliding rail is disposed in the sliding chute, and the dynamic magnet is disposed on the sliding rail.

13. The magnetic proximity switch of claim 11, wherein the elastic component A and the elastic component B are elastic sheets.

14. The magnetic proximity switch of claim 11, wherein the top of the wiring terminal A is provided with a support frame, and the left end of the balance plate is hinged to the supporting frame.

15. The magnetic proximity switch of claim 11, wherein the magnet-attracted component A and the magnet-attracted component B are iron rivets.

* * * * *